United States Patent [19]

Williams

[11] Patent Number: 4,461,695

[45] Date of Patent: Jul. 24, 1984

[54] SOLVENT EXTRACTION OF DIATOMITE

[75] Inventor: William Williams, College Station, Tex.

[73] Assignee: Getty Oil Company, Houston, Tex.

[21] Appl. No.: 479,688

[22] Filed: Mar. 28, 1983

[51] Int. Cl.[3] ..... C10G 1/04

[52] U.S. Cl. ..... 208/8 LE; 208/11 R; 208/11 LE

[58] Field of Search ..... 208/8 R, 8 LE, 11 R, 208/11 LE

[56] References Cited

U.S. PATENT DOCUMENTS

| | | | |
|---|---|---|---|
| 4,008,145 | 2/1977 | Leas | 208/8 LE |
| 4,167,470 | 9/1979 | Karnofsky | 208/8 |
| 4,239,617 | 12/1980 | Karnofsky | 208/321 |
| 4,253,938 | 3/1981 | Roma | 208/8 R |
| 4,374,023 | 2/1983 | Davis | 208/8 LE |

FOREIGN PATENT DOCUMENTS 621844 6/1961 Canada ..... 208/11 LE

OTHER PUBLICATIONS

J. H. Cottrell, "Development of an Anhydrous Process for Oil-Sand Extraction", 1963, pp. 193-206.

*Primary Examiner*—Delbert E. Gantz
*Assistant Examiner*—Anthony McFarlane
*Attorney, Agent, or Firm*—Arnold, White & Durkee

[57] ABSTRACT

There is provided a method of extracting hydrocarbons from a diatomite ore. The particle size of the ore is first reduced to form a processed ore. The processed ore is then mixed with a substantially irregular granular material to form an unstratified ore mixture having increased permeability to an extracting solvent. The unstratified ore mixture is then permeated with an extracting solvent to obtain a hydrocarbon-solvent stream from which hydrocarbons are subsequently separated. The irregular granular material may be sand.

12 Claims, 3 Drawing Figures

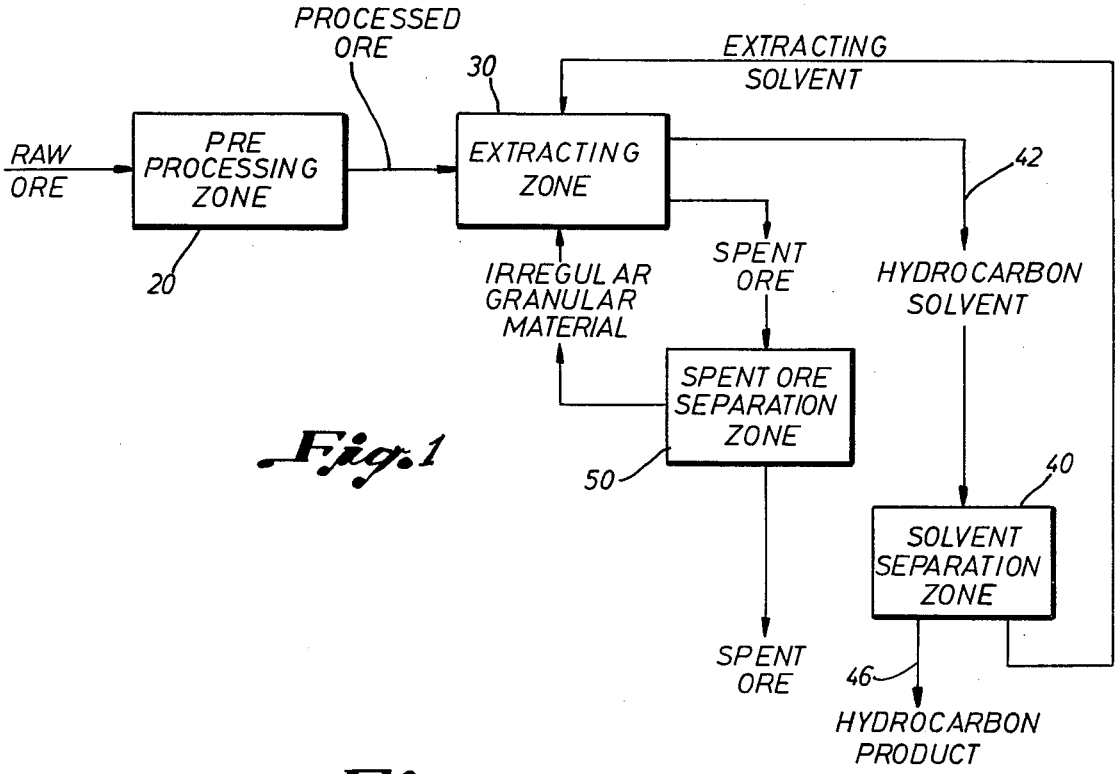
Fig. 1
Fig. 2
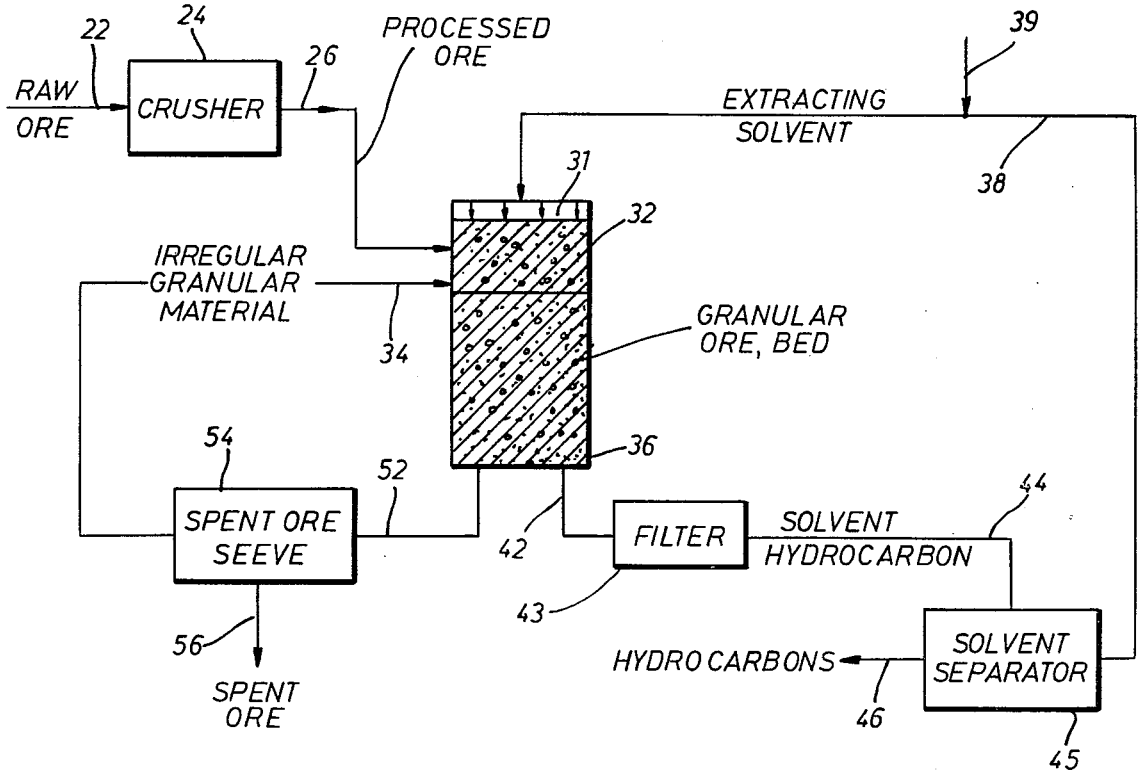

SOLVENT EXTRACTION OF DIATOMITE

BACKGROUND OF THE INVENTION

There is provided an improved process for extracting hydrocarbons from a solid material and more particularly an improved process from extracting hydrocarbons from a diatomite ore by increasing the permeability of the diatomite ore to an extracting solvent.

Many earth formations contain deposits having substantial amounts of hydrocarbons. Included among these are oil bearing diatomaceous earths. It is known that a diatomaceous earth may act as a filter under the appropriate circumstances. However, where hydrocarbons are to be recovered by means of solvent extraction it is generally necessary to reduce the diatomite ore to fine particles in order to provide sufficient contact between the solvent and the hydrocarbons. Once the diatomite ore has been crushed it becomes sufficiently fine so as to prevent the passage of solvent therethrough if it remains in a stationary bed. Thus, a variety of processes have developed which use settlement techniques and a number of stages to bring the extracting solvent into contact with the diatomite ore and successively separate off the resulting oil-solvent mixtures.

A variety of extraction processes have been proposed for the removal of oil or other hydrocarbons from diatomaceous earths. For example, U.S. Pat. Nos. 4,239,617 and 4,167,470 issued to Karnofsky describe a process which attempts to recover petroleum crude oil from oil laden diatomite by a continuous stage wise countercurrent extraction-decantation process. Ore is extracted by countercurrent decantation with a hydrocarbon solvent. Solvent is recovered from the extract by multiple effect evaporation followed by stripping. The spent diatomite is contacted with water and solvent is recovered from the resulting aqueous slurry of spent diatomite by steam stripping at superatmospheric pressure.

As indicated in column two of each of those patents a heated slurry of diatomite and solvent is discharged into a settling zone where the particles of diatomite settle to the bottom as a thixotropic mud for removal through an underflow mechanism. Overflow from this first stage is then passed to a clarifier where fine solid material settles to the bottom. A series of extraction stages comprising mixers and thickeners is employed to further extract the oil and separate out any solid material including any fines.

J. H. Cottrell, "Development of an Anhydrous Process for Oil-Sand Extraction," published in M. A. Carrigy, ed., Athabasca Oil Sands: A Collection of Papers, Edmonton, Alberta: Research Council of Alberta, 1963 (hereinafter the Cottrell paper) discloses an anhydrous solvent extraction process using a three-stage drain circuit to extract hydrocarbons from water-wet Athabasca oil sands. Process conditions are controlled to ensure that the inner film of water coating the sand particles and surrounded by a bitumen film is maintained in order to enhance the free flow of hydrocarbons through an oil-sand bed. This was explained under the theory that the apparent diameters of the solid-water particles randomly laid-down in the draining step were quite uniform and were larger than those of most dry solids existing within a given oil-sand sample.

In a commercial plant proposed in the Cottrell article oil sand and hydrocarbon solvent would be mixed in a mixer and then passed as a slurry on a moving belt through three consecutive drains. A mixture of solvent and hydrocarbon would pass through the slurried bed in each drain under appropriate process conditions to maintain the water film. Solvent would subsequently be recovered from the spent slurry by steam stripping and from the raw bitumen product recovered from the first drain by fractionation.

These and other processes have suffered from one or more of several defects or limitations. For example, as evidenced by the foregoing processes there must generally be a relatively complex series of steps to separate off the solvent oil mixture from any spent diatomite ore. Similarly, a variety of equipment must often be employed to insure that the oil solvent mixture does not contain an excessive amount of fines. These and other limitations are substantially minimized if not eliminated by the present inventive method.

SUMMARY OF THE INVENTION

In accordance with the present invention there is generally provided a hydrocarbon extraction process for removing hydrocarbons from a diatomaceous earth. The ore is first processed by reducing the particle size of the ore. A substantially irregular granular material is then mixed with the processed ore to form an unstratified ore mixture. The diameter and size range of the irregular granular material is such that the resulting mixture has an increased permeability to the solvent. The ore mixture is subsequently permeated with an extracting solvent to produce a hydrocarbon-solvent stream. The hydrocarbons may then be subsequently separated from the hydrocarbon-solvent stream. Additionally, although the amount of fines in the hydrocarbon solvent stream is reduced than would otherwise be the case if the unstratified ore mixture were not employed, all or a portion of any fines remaining in the hydrocarbon-solvent stream may subsequently be removed by filtering.

In another embodiment there is provided a method of extracting hydrocarbons from a diatomite ore wherein the particle size of the diatomite ore is first reduced to form a processed ore. A granular material, such as sand, is subsequently mixed with the processed ore in an extracting zone to form an unstratified ore column. The granular material has a shape and size range sufficient to avoid packing of the processed ore while not allowing any fines in the processed ore to sift through the granular material and form stratified layers of fines. An extracting solvent is then distributed from the top of the ore column and allowed to permeate the ore column to produce a hydrocarbon-solvent stream, while leaving behind a spent ore mixture. A portion of any fines is then filtered from the hydrocarbon-solvent stream and the extracting solvent is then separated from the hydrocarbon-solvent stream thus resulting in the formation of a hydrocarbon product stream and an extracting solvent stream. The extracting solvent stream may then be recycled for further mixing with the unstratified ore column. Once a substantial portion of the hydrocarbons are removed from the ore column, the spent ore mixture is removed from the extracting zone. Granular material is then separated from the spent ore mixture for recycle and use with fresh processed diatomite ore.

BRIEF DESCRIPTION OF THE DRAWINGS

FIG. 1 is a flow chart depicting one embodiment of the present invention;

FIG. 2 is a flow chart of an embodiment of the present invention; and

Figure 3:
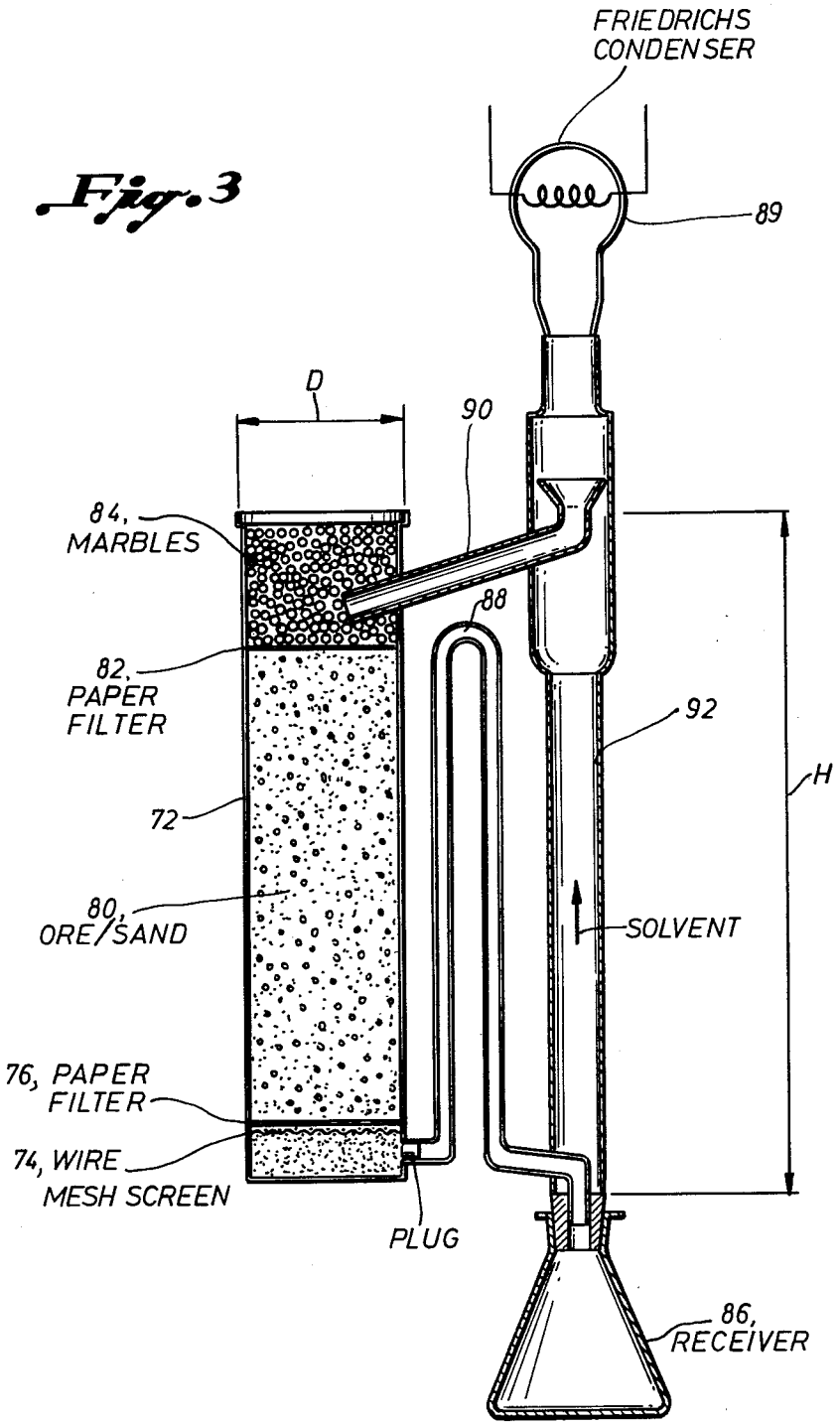
FIG. 3 is a shematic view of an experimental apparatus for use in the present invention.

There follows a detailed description of a preferred embodiment of the present inventive method in conjunction with the foregoing drawings. This description is to be taken by way of illustration rather than limitation.

DETAILED DESCRIPTION

Referring generally to FIG. 1 there is shown a schematic outline of one embodiment of the present invention. Referring generally to that figure a raw ore is processed in a preprocessing zone 20. The processed ore is then passed to an extracting zone 30 where it forms an unstratified ore mixture with an irregular granular material, such as sand, which is also fed to extracting zone 30. Extracting solvent is then fed to extracting zone 30 to permeate the unstratified ore mixture, thus resulting in the formation of a hydrocarbon solvent stream which passes via line 42 to solvent separation zone 40. Extracting solvent is then separated from the hydrocarbon solvent stream in solvent separation zone 40 to a produce hydrocarbon product stream in line 46. The extracting solvent is preferably recycled back to the extracting zone 30.

Once a substantial portion of the hydrocarbons have been extracted from the diatomite ore in the unstratified ore mixture, the spent ore mixture is removed from the extracting zone 30 and passed to the spent ore separation zone 50 wherein the irregular granular material, such as sand, is separated from the spent ore for recycle back to extraction zone 30.

Referring more particularly to FIG. 2, the preprocessing zone 20 may be comprised of a crusher 24 to which raw ore is fed via line 22. The ore is therein crushed and reduced in size to promote solvent contact with the hydrocarbons contained in the ore. The exact size reduction will vary according to process conditions including the type of solvent employed and the amount of nonporous granular material used as would be known to one skilled in the art having the benefit of this disclosure. However, it is preferable that the raw ore be reduced substantially in size without regard to whether or not a substantial amount of fines will be produced.

The crusher 24 may be of conventional construction as would be known to one skilled in the art having the benefit of this disclosure. Additionally, the preprocessing zone may also be supplied with a drier (not shown) if the ore is to be dried prior to contact with the extracting solvent.

The processed ore then passes via line 26 to extracting column 32 in extraction zone 30. An irregular granular material, such as sand, passes via line 34 to extracting column 32 where it is mixed with the processed ore to form an unstratified ore mixture or fixed bed of ore indicated at 36.

A wide variety of granular materials may be employed. However, the granular material should be of such a shape and within a sufficient size range to avoid packing and so not hinder the movement of solvent through the ore mixture yet not be so large as to allow the fines in the processed ore to sift through the granular material and form stratified layers of fines. The granular material is irregular in shape and preferably has a range of sizes. For example, a sand passable through a variety of mesh sizes may be employed. It is also believed that other irregular shapes of granular particles such as porcelain column packing may be employed to advantage.

The irregular granular material and the processed ore should be thoroughly mixed to further minimize the potential for stratification of either the granular particles or the processed ore. For example, it may be appropriate to add the irregular granular material and the processed ore simultaneously to the extractor column. Alternately, appropriate mixing devices may be employed as would be known to one skilled in the art having the benefit of this disclosure. By way of example, the granular material and the processed ore may be mixed prior to placement in the extractor 32.

Once the unstratified granular ore bed 36 is established within the extracting column 32, an extracting solvent is passed via line 38 and allowed to permeate through the granular ore bed 36. As shown in FIG. 2 the extracting solvent passing from line 38 is preferably distributed through a distribution system indicated at 31. By way of example, the distribution system may be a series of spray nozzles or a plate with a plurality of holes spaced along its surface. A variety of other devices may be employed to insure the uniform distribution of the extracting solvent along the top portion of the granular ore bed 36 as would be known to one skilled in the art having the benefit of this disclosure.

The solvent may be any one of a number of appropriate extracting solvents known to those skilled in the art. For example the solvent may comprise tetrahydrofuran or methlyene chloride. The solvent is preferably more volatile than the hydrocarbons contained in the diatomite ore in order to facilitate the separation of the extracting solvent from the recovered hydrocarbons downstream of the extracting zone 30.

As the extracting solvent permeates the granular ore bed 36 in extracting column 32, it contacts the processed ore, thus resulting in the formation of a solvent-hydrocarbon stream, which passes via line 42 from the extracting zone 30. Although not always necessary, it may sometimes be preferable to employ a filter 43 to remove any remaining fines from the solvent-hydrocarbon stream prior to its passage to the solvent separation zone 40. Although the use of an unstratified ore mixture in the extracting zone 30 reduces the amount of fines in the solvent-hydrocarbon stream, it may still be necessary to further reduce the amount of any remaining fines depending upon conditions in the solvent separation zone and the type of hydrocarbon product desired.

The solvent-hydrocarbon stream passes via line 44 to the solvent separation zone 40. The solvent separation zone 40 may comprise a solvent separator 45, such as a distillation column or the like as would be known to one skilled in the art having the benefit of this disclosure. The hydrocarbon product passing via line 46 may be further processed as desired or sold as a raw crude.

The extracting solvent recovered in the solvent separator 45 is preferably recycled via line 38 to the extracting zone 30. As a portion of the extracting solvent will generally be lost either by passage with hydrocarbons in line 46 or with the spent ore mixture in line 52, additional extracting solvent should be supplied via line 39.

Once substantially all of the hydrocarbons are removed from the unstratified granular ore bed 36, the flow of solvent via line 38 is terminated and any remaining solvent including any dissolved hydrocarbons are allowed to pass via line 42 from the extracting column 32. The granular ore bed is then removed from the extracting column 32 and passes via line 52 to spent ore separation zone 50.

The configuration of the spent ore separation zone 50 will be a function of the particle sizes of the irregular granular material and the spent ore as well as the amount of any remaining solvent or hydrocarbons. However, a wide variety of devices may be used. For example, if all of the spent ore particles are smaller than the irregular granular material and the spent ore is relatively dry, then it will most likely only be necessary to employ one sieve to separate out the spent ore from the irregular granular material. Thus the spent ore separation zone 50 may comprise a spent ore sieve 54 whereby the spent ore is physically separated from the irregular granular material, which is recycled via line 34. The spent ore passes via line 56 for further processing or disposal as appropriate.

A variety of variations on the foregoing unit operations in various zones may be accomplished. For example, the size range of the recycled granular material may be controlled by the use of an additional sieve of the like in line 34.

The following examples are provided by way of further illustration rather than limitation.

EXAMPLES

The experimental apparatus employed in examples 1 and 2 is shown in FIG. 3. It generally comprises a modified Soxhlet extractor. Soxhlet extractors are used for continuous liquid-solid extraction. Generally, a finely ground solid is placed in an extraction shell and fresh solvent is allowed to percolate through the sample with the extracted material accumulating in a solvent distillation flask located beneath the shell.

A Soxhlet extractor was modified as shown in FIG. 3. A shell 72 approximate 10 centimeters in diameter and 40 centimeters in length was equipped with a wire mesh screen 74. A finely ground sand, such as a Clemtex number 5 sand, was placed in the bottom of the shell 72 below the wire mesh screen 74. A layer of qualitative filter paper 76 was placed above the wire mesh screen and a fiberglass wool plug 78 was placed at the lower outlet of the shell 72. The wire mesh screen 74 served to support the qualitative filter paper 76, which along with the Clemtex number 5 sand and the fiberglass wool plug served as a filter for removal of fines.

An appropriate ore sand mixture was then placed in the shell 72 to form an unstratified ore mixture 80. The ore mixture 80 was then topped with an additional layer of qualitative filter paper 82 which served to enhance the uniform distribution of any solvent passing through the ore bed 80. Marbles 84 were added in order to reduce the overall amount of solvent within the shell 72.

The shell 72 was then placed in communication with a receiver or flask 86 by means of a U-shaped tube 88. The upper portion of the shell 72 was placed in communication with a condensor 88 by means of a tube 90. The receiver 86 and the condensor 88 were in turn placed in communication with each other by means of tube 92.

In conducting the experiments solvent was passed through the ore mixture 80 with any fines being filtered out by qualitative filter paper 76, the finely ground sand and the fiberglass wool plug 78. The resulting hydrocarbon solvent mixture then passed via tube 88 to receiver 86. The solvent was then vaporized, separating the solvent from the recovered oil, and subsequently condensed in the condensor 89. The condensed solvent was then passed through tube 90 to continue or repeat the process. The oil and solvent collected in receiver 86 were subsequently separated. This was generally done in a separate unit in order to facilitate solvent recovery by use of a vacuum and save time by allowing immediate preparation of an ore/sand bed in shell 72.

EXAMPLE 1

404.2 grams of diatomite ore and 521.2 grams of flint shot sand were added to the shell 72 to provide an unstratified ore bed having a sand to ore ratio of 1.3 to 1. Methylene chloride was then brought into contact with the bed. The methylene chloride penetrated the bed and was subsequently recovered in the receiver 86 along with dissolved hydrocarbons. The methylene chloride was then removed under vacuum from the hydrocarbon oil mixture until no further condensate was visible. The resulting oil had a consistency of honey at room temperature with a slight methylene chloride odor. Approximately 96.5 grams of oil were recovered which based on the weight of the original ore provided a yield of about 23.9% by weight.

EXAMPLE 2

Tetrahydrofuran was used as an extraction solvent in much the same fashion as in example 1. 781.5 grams of ore and 1,137.5 grams of flint shot sand were used to provide an unstratified ore bed having a sand to ore ratio of 1.46 to 1.0. Approximately 196.5 grams of oil were recovered for a yield of about 25.0% by weight.

EXAMPLE 3

In a separate laboratory test, a sand blasting sand having a 16/35 mesh (Clemtex number 3 sand) was mixed with diatomite ore in the ratio of 4 parts sand to 5 parts ore by weight. A tetrahydrofuran solvent was then passed through a column 9 centimeters in diameter by 25 centimeters in height at a high enough rate to completely extract the oil from the ore in 8 to 12 hours. In the absence of the sand, the tetrahydrofuran solvent would only penetrate the same bed of ore to a depth of one to two centimeters.

EXAMPLE 4

In another laboratory test a diatomite ore was mixed with smooth glass beads having a diameter of about 6 millimeters. A solvent was then fed to the top of the diatomite ore/ glass bead mixture, but failed to penetrate the bed, thus indicating that smooth regular shaped particles of too large a diameter and in approximately one size range would not sufficiently increase the permeability of the ore bed.

Although the foregoing discussion as well as the examples have been directed to the use of the invention in connection with the extraction of an oil bearing diatomaceous earth or diatomite ore, it should be understood that the invention can also be used to advantage in conjunction with the extraction of hydrocarbons from a variety of hydrocarbon containing ores where fines prevent the permeation of a bed of the ore.

Further modifications and alternative embodiments of the inventive method and apparatus will be apparent to those skilled in the art having the benefit of this disclosure. Accordingly, this description and the examples are to be construed as illustrative only and for the purpose of teaching those skilled in the art the manner of carrying out the invention according to the patent statutes. For example, equivalent materials may be substituted for those specifically illustrated and described herein and certain features of the invention may be utilized independently of the use of other features. All this would be apparent to one skilled in the art after having the benefit of this description of the invention.

What is claimed is:

1. A method of extracting hydrocarbons from a diatomite ore comprising the steps of:

reducing the particle size of the ore to from a processed ore;

mixing a substantially irregular granular material with the processed ore to form an unstratified ore mixture having increased permeability, said granular material being substantially insoluble in an extracting solvent, and said granular material containing substantially no natural hydrocarbon deposits just prior to mixing with the processed ore, said granular material having a shape and size range sufficient to avoid packing of the processed ore as would substantially impair the permeation of said extracting solvent capable of dissolving hydrocarbons from the ore through the unstratified ore mixture while not allowing any fines in the processed ore to form one or more stratified layers of fines sufficient to substantially impair penetration of the extracting solvent through one or more of the layers; and permeating the unstratified ore mixture with the extracting solvent capable of dissolving hydrocarbons from the ore to form a hydrocarbon-solvent stream.

2. A method according to claim 1 further comprising the step of separating hydrocarbons from the hydrocarbon-solvent stream.

3. A method according to claim 1 wherein the substantially irregular granular material is sand.

4. A method according to claim 1 further comprising the step of filtering at least a portion of any fines from the hydrocarbon-solvent stream.

5. A method according to claim 1 wherein the extracting solvent is uniformly distributed across the top of the unstratified ore mixture.

6. A method according to claim 1 wherein the processed ore is dried to remove water from the ore prior to mixing the processed ore with the substantially irregular granular material.

7. A method of extracting hydrocarbons from a diatomite ore comprising the steps of:

reducing the particle size of the ore to produce a processed ore;

mixing a granular material with the processed ore in an extracting zone to form an unstratified ore column having increased permeability, said granular material at least initially containing substantially no natural hydrocarbon deposits and having a shape and size range sufficient to avoid packing of the processed ore while not allowing any fines in the processed ore to sift through the granular material and form stratified layers of fines;

distributing an extracting solvent capable of dissolving hydrocarbons from the processed ore from the top of the ore column and allowing the solvent to permeate the ore column to form a hydrocarbon solvent stream while leaving behind a spent ore mixture;

filtering a portion of any fines from the hydrocarbon-solvent stream;

separating extracting solvent from the hydrocarbon-solvent stream to form a hydrocarbon product stream and an extracting solvent stream;

removing the spent ore mixture from the extracting zone; and separating granular material from the spent ore mixture.

8. A method according to claim 7 further comprising the step of drying the processed ore prior to mixing the processed ore with the granular material.

9. A method of extracting hydrocarbons from pieces of a diatomite ore comprising the steps of:

reducing the size of the pieces of ore to form a processed ore;

mixing a non-oil bearing sand which is passable through a plurality of mesh sizes with the processed ore to form an ore mixture having increased permeability, said sand having a shape and size range so as to sufficiently minimize packing of the processed ore when mixed with processed ore to allow permeation of an extracting solvent capable of dissolving hydrcarbons from the ore through the ore mixture while not allowing any fines in the processed ore to substantially impair permeation of the extracting solvent through the ore mixture; and passing the hydrocarbon extracting solvent through the ore mixture to obtain a hydrocarbon-solvent stream.

10. A process according to claim 9 wherein the hydrocarbon extracting solvent comprises tetrahydrofuran.

11. A process according to claim 9 wherein the hydrocarbon extracting solvent comprises methylene chloride.

12. A process according to claims 1, 7 or 9 wherein the extracting solvent consists essentially of substances more volatile than the hydrocarbons contained in the diatomite ore.

* * * * *